US011529786B2

(12) United States Patent
Crackett et al.

(10) Patent No.: US 11,529,786 B2
(45) Date of Patent: Dec. 20, 2022

(54) MACHINE FOR ERECTING LINERLESS CARTONS

(71) Applicants: Visy R & D Pty Ltd, Southbank (AU); Mercer Stainless Limited, Sockburn Christchurch (NZ)

(72) Inventors: Grant Antony Crackett, Ascot Vale (AU); Adrian Michael Dalgleish, Whittlesea (AU); Paul Merkel, Auckland Central (NZ); Leighton Markham, New Plymouth (NZ)

(73) Assignees: Mercer Stainless Limited, Christchurch (NZ); Visy R & D Pty Ltd, Victoria (AU)

( * ) Notice: Subject to any disclaimer, the term of this patent is extended or adjusted under 35 U.S.C. 154(b) by 126 days.

(21) Appl. No.: 15/624,194

(22) Filed: Jun. 15, 2017

(65) Prior Publication Data

US 2017/0361559 A1 Dec. 21, 2017

(30) Foreign Application Priority Data

Jun. 15, 2016 (AU) ..... 2016902321

(51) Int. Cl.

| | |
|---|---|
| ***B31B 50/46*** | (2017.01) |
| ***B31B 50/52*** | (2017.01) |
| ***B31B 50/59*** | (2017.01) |
| ***B31B 50/62*** | (2017.01) |
| ***B65D 5/24*** | (2006.01) |

(Continued)

(52) U.S. Cl.

CPC ..... *B31B 50/592* (2018.05); *B31B 50/46* (2017.08); *B31B 50/52* (2017.08); *B65D 5/244* (2013.01); *B31B 50/624* (2017.08); *B31B 50/626* (2017.08); *B31B 2100/0024* (2017.08); *B31B 2110/35* (2017.08); *B31B 2120/40* (2017.08); *B65D 5/4266* (2013.01); *B65D 5/4287* (2013.01); *B65D 5/563* (2013.01)

(58) Field of Classification Search

CPC . B31B 50/46; B31B 50/52; B31B 2100/0024; B65D 5/244

USPC ..... 229/171; 493/174, 143, 136, 167, 171

See application file for complete search history.

(56) References Cited

U.S. PATENT DOCUMENTS 641,722 A * 1/1900 McCandless ..... B65D 5/248 229/120

1,651,200 A * 11/1927 Goss ..... B31B 50/00 493/167

(Continued)

*Primary Examiner* — Thanh K Truong

*Assistant Examiner* — Patrick B Fry

(74) *Attorney, Agent, or Firm* — Schwegman Lundberg & Woessner, P.A.

(57) ABSTRACT

A method of erecting a carton from a blank, including:

engaging the blank with a punch head against which the carton is formed, folding side portions of the blank against the punch head to form sides of the carton;

folding outer portions of the side portions of the blank away from the punch head and against an external side of the carton;

folding end portions of the blank against the punch head to form end portions of the carton;

folding outer portions of the end portions of the blank away from the punch head and against an external end of the carton; and securing corner gussets formed between the side and end portions against sides or ends of the carton.

6 Claims, 8 Drawing Sheets

(51) Int. Cl.

| | |
|---|---|
| ***B65D 5/42*** | (2006.01) |
| ***B65D 5/56*** | (2006.01) |
| *B31B 120/40* | (2017.01) |
| *B31B 110/35* | (2017.01) |
| *B31B 100/00* | (2017.01) |

(56) References Cited

U.S. PATENT DOCUMENTS 2,071,949 A * 2/1937 Reich ..... B65D 5/2047
229/104
2,085,038 A * 6/1937 Perreton ..... B65D 5/2033
229/103
2,630,263 A * 3/1953 Ringler ..... B65D 5/248
229/125.26
2,669,914 A * 2/1954 Swaine ..... A21B 3/131
126/39 M
2,863,370 A * 12/1958 Dorfman ..... B31B 50/00
493/136
2,925,758 A * 2/1960 Beetz ..... B31B 50/00
493/136
2,944,719 A * 7/1960 Arneson ..... B65D 5/248
229/171
3,078,171 A * 2/1963 Skowronski ..... B65D 5/2047
229/104
4,197,789 A * 4/1980 Moen ..... B31B 50/00
493/167
4,295,839 A * 10/1981 Baker ..... B65D 5/2047
493/143
4,636,187 A * 1/1987 Oakley ..... B31B 70/00
493/134

* cited by examiner

MACHINE FOR ERECTING LINERLESS CARTONS

CLAIM FOR PRIORITY

This application claims the benefit of priority of Australian Application No. 2016902321, filed Jun. 15, 2016, entitled "Machine For Erecting Linerless Cartons", which is hereby incorporated in its entirety.

FIELD OF THE INVENTION

The present invention relates to a method of erecting a carton from a blank and an apparatus for erecting a carton from a blank. More particularly, but not exclusively, the invention relates to erecting liner-less cartons of the type used in the transportation of perishable goods such as meat.

BACKGROUND OF THE INVENTION

Previously, to prevent contact between perishable goods and a carton used to transport the goods, a liner, such as a polyethylene bag, has been used. However, use of such bags increases costs and handling time and can present contamination risks.

SUMMARY OF THE INVENTION

It is proposed to use a carton formed of a combination of barrier papers and/or board, which can include coated, food grade or waterproof paper or plastic laminated paper and/or board, to provide a leak proof design and avoid the need for a separate liner. However, diecut raw side edges of the carton are still required to avoid contact with the goods and this presents difficulties in erecting a carton formed of a combination of barrier papers. What is needed is an apparatus and method for forming a carton from a blank of a combination of barrier materials so that a liner bag is no longer required.

Examples of the invention seek to solve, or at least ameliorate, one or more disadvantages of previous methods of erecting cartons from a blank.

According to the present invention, there is provided a method of erecting a carton from a blank, including:

- engaging the blank with a punch head against which the carton is formed,
- folding side portions of the blank against the punch head to form sides of the carton;
- folding outer portions of the side portions of the blank away from the punch head and against an external side of the carton;
- folding end portions of the blank against the punch head to form end portions of the carton;
- folding outer portions of the end portions of the blank away from the punch head and against an external end of the carton, and
- securing corner gussets formed between the side and end portions against sides or ends of the carton.

According to a preferred embodiment, the blank is supported along outer edges prior to engagement with the punch head to partially fold the side and end portions as the blank is engaged with the punch head.

Preferably, the outer side and end portions of the blank are folded by at least one engagement member extending along sides of the punch head. The or each engagement member can include a plurality of fingers pivotably fixed to the punch head. The fingers may prevent the outer portions of the side and end portions of the blank folding completely so as to lie against the punch head.

Preferably, the method is performed with a blank of paper based material coated with a waterproof coating or plastic laminated paper and/or board.

The method can further include the step of applying glue to side and end portions of the blank for securing the outer side and end portions once folded. The punch head can operatively correspond to an internal portion of the carton.

Folding of the side and end portions of the blank can be completed with pushers extending towards the punch head.

According to the invention there is also provided an apparatus for erecting a carton from a blank using the above described method, the apparatus including:

- a support for supporting the blank near outer edges thereof;
- a vertically operable punch head for engaging the blank and against which sides and ends of the carton can be formed; and
- at least one engagement member extending along sides of the punch head for folding the outer portions of the side and end portions away from the punch head and against respective external sides and ends of the carton.

According to preferred embodiments, the at least one engagement member includes a plurality of fingers pivotably fixed to the punch head. The fingers may prevent the outer side and end portions of the blank folding completely so as to lie against the punch head. The support may be a support frame Preferably, the apparatus further includes pushers extending towards the punch head for folding of the side and end portions of the blank against the punch head. Preferably, the punch head operatively corresponds to an internal portion of the carton.

The apparatus can further include means for applying glue to the outer portions of the side and end portions of the blank for securing the outer side and end portions once folded.

BRIEF DESCRIPTION OF THE DRAWINGS

Preferred embodiments of the invention will be further described, by way of non-limiting example only, with reference to the accompanying drawings in which.

DETAILED DESCRIPTION

Figure 1:
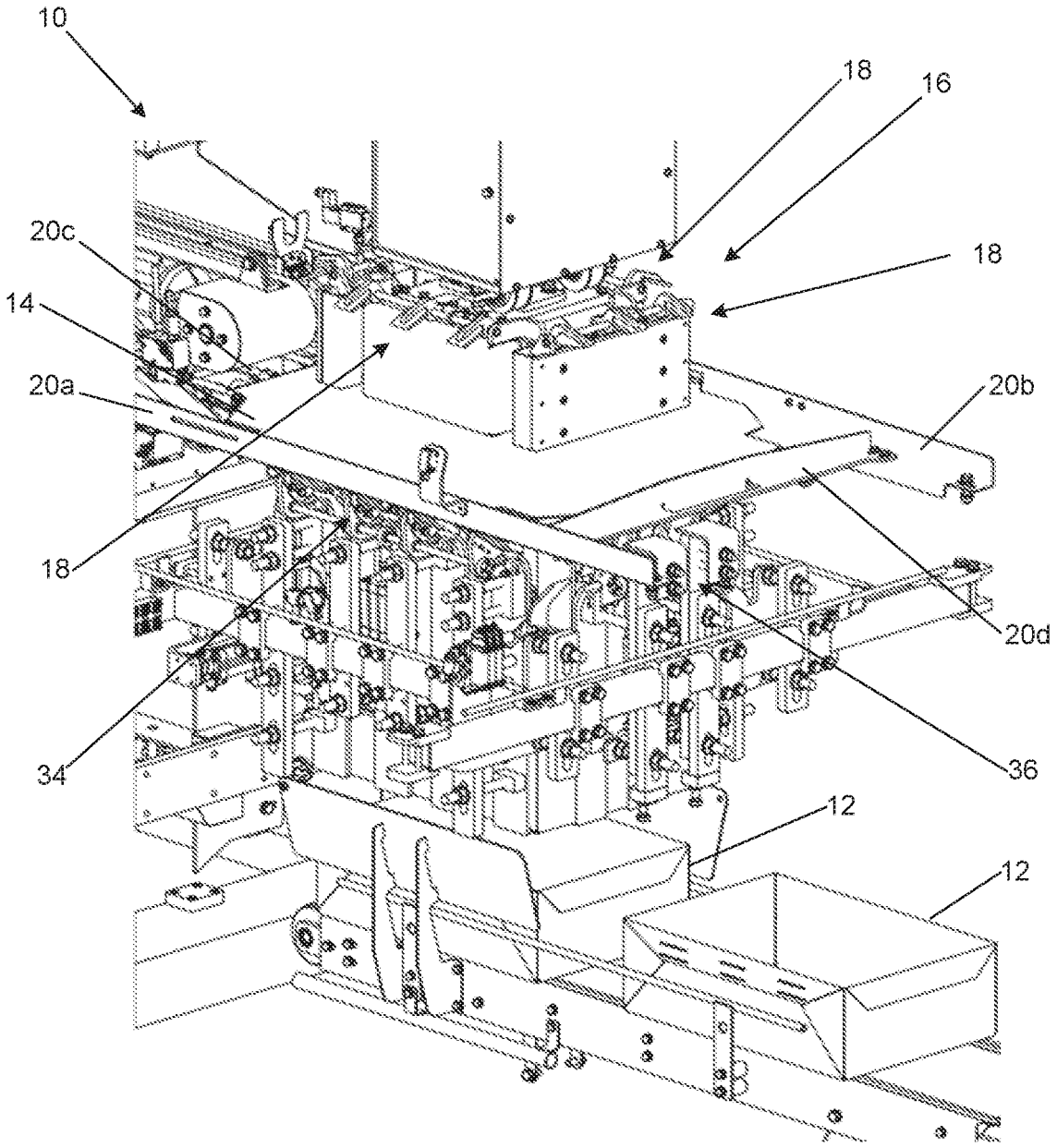
FIGS. 1 to 5 are perspective views of an apparatus for erecting a carton from a blank using a method of one embodiment of the invention, the apparatus having detail removed for clarity and the Figures progressively illustrating the forming of the carton.

With reference to FIG. 1, there is shown an apparatus 10. The apparatus 10 is configured for erecting a carton 12 from a blank 14.

The apparatus 10 includes a support, in the form of support frame 20, for supporting the blank 14 near outer edges thereof. The support frame 20 includes transfer rails in the form of side support members 20*a*, 20*b*, formed of elongate members that extend along sides of the blank, and end support members 20*c*, 20*d* for supporting ends of the blank. End support member 20*d* is an elongate member as per side support members 20*a*, 20*b*, however, end support member 20*c* is in the form of two rails for guiding the blank into the apparatus, the rails terminating so that an end of the rails supports an end of the blank.

The side support members 20*a*, 20*b* are formed from lengths of angled section, which in the described embodiment is 90 degree angled section, to guide and support the blank as it is directed toward a punch head 16. It will be appreciated that the side and end support members may take other forms.

Figure 6:
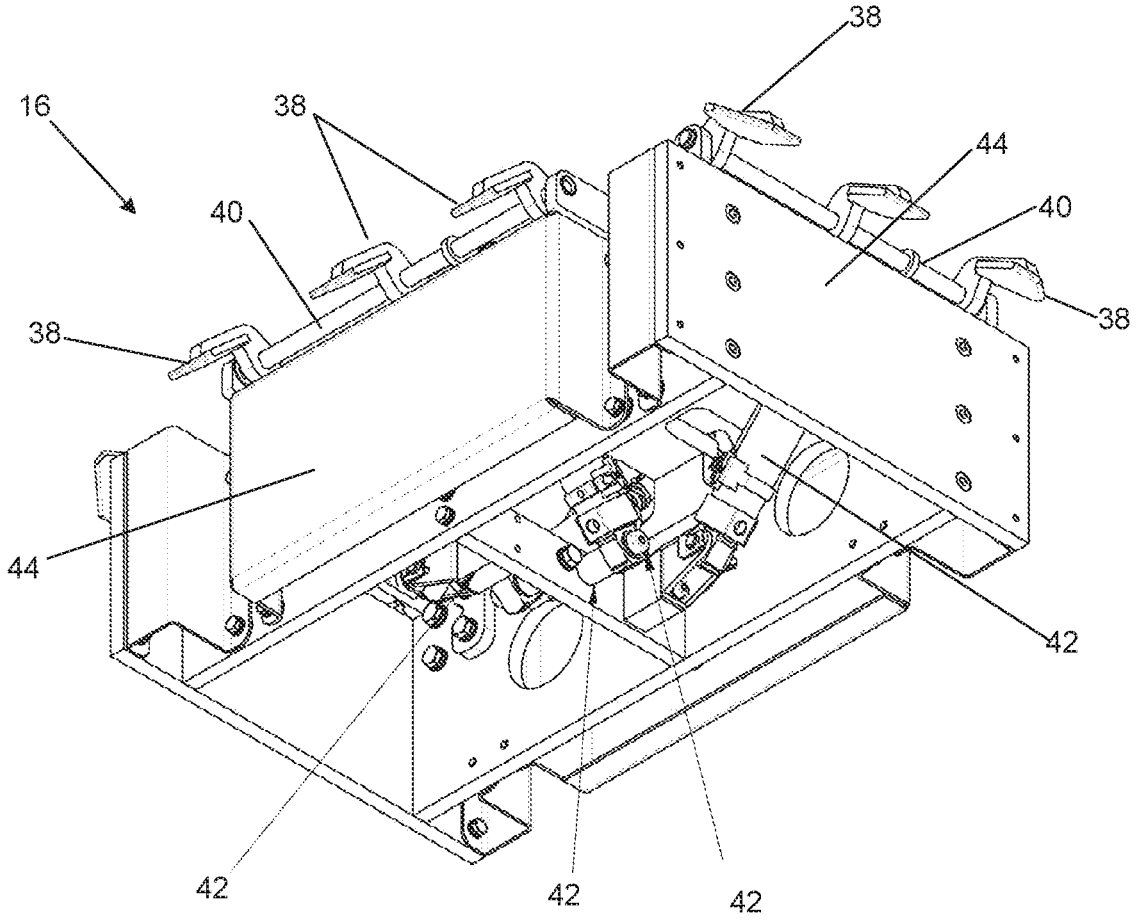
FIG. 6 is a perspective view of a punch head used in the apparatus.
Figure 7:
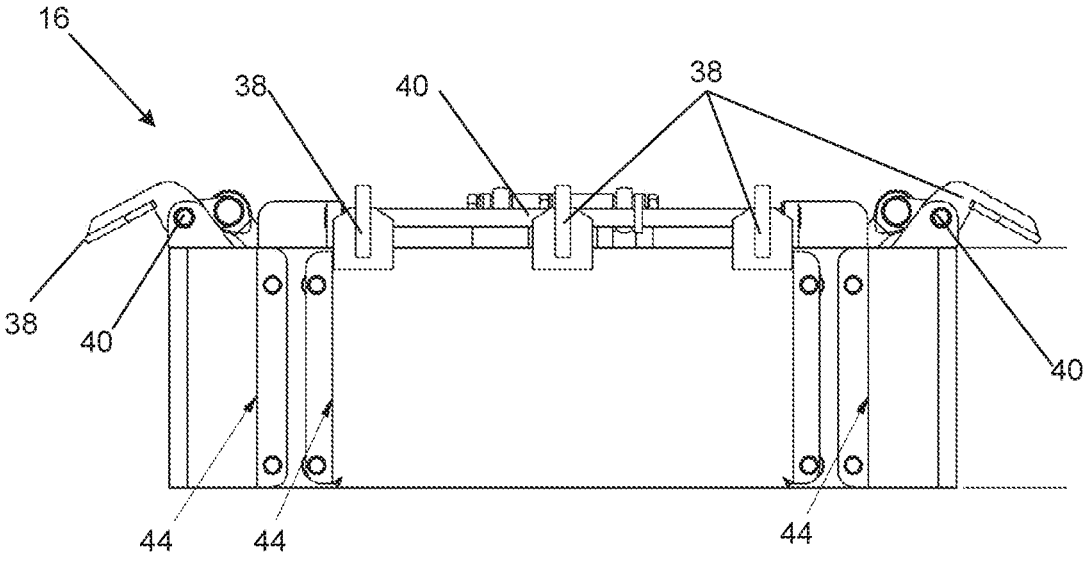
FIG. 7 is a side view of the punch head.
Figure 8:
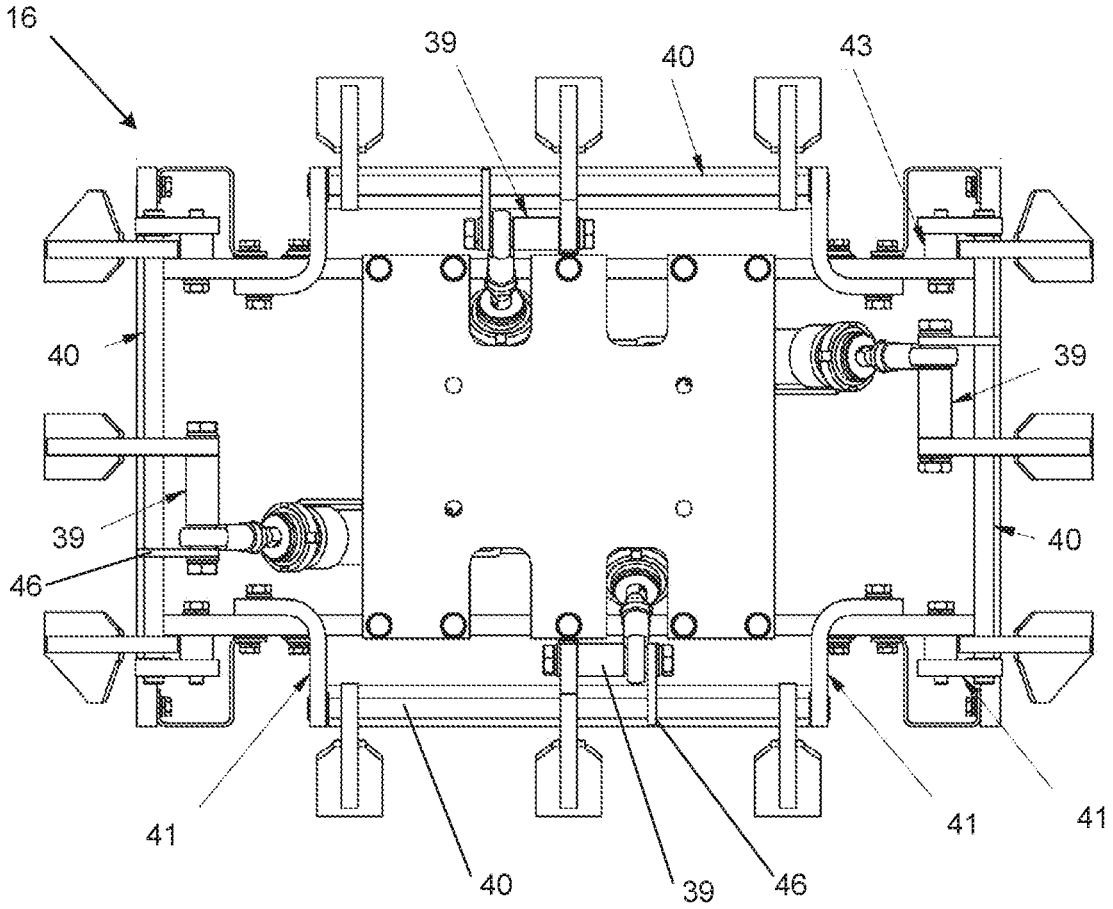
FIG. 8 is a plan view of the punch head.
Figure 9:
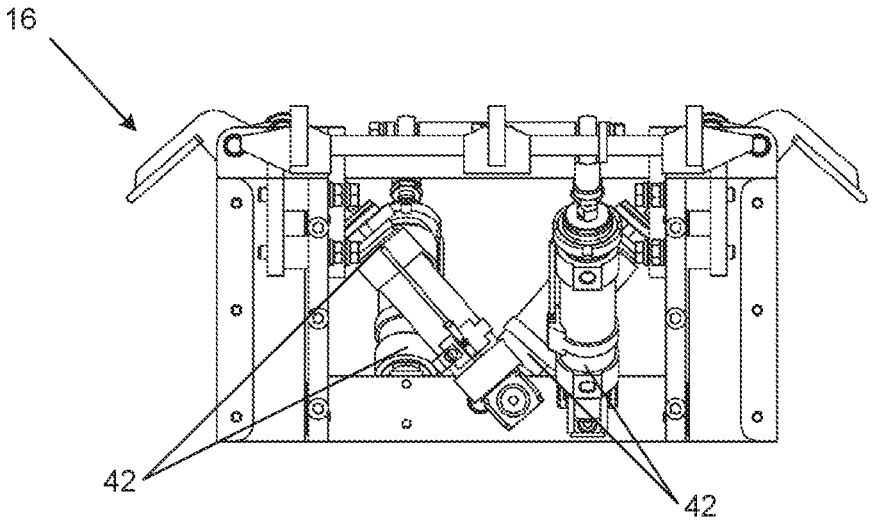
FIG. 9 is an end view of the punch head with panelling removed.

The apparatus 10 also includes a vertically operable punch head 16 for engaging the blank 14 and against which sides and ends of the carton 12 can be formed. In the described illustrated embodiment, the punch head 16 lowers to engage the blank, though it will be appreciated that reverse operation where the punch head 16 engages the blank from underneath, will also be possible. The punch head 16 operatively corresponds to an internal portion of the carton 12 so that the carton 12 may be formed against and around the punch head 16. In this regard, the punch head 16 has side panels 44 (see FIG. 6) against which the carton 12 is formed, though it will be appreciated by those skilled in the art that panels need not be continuous and may have voids in between.

The punch head 16 operates via a belt driven linear drive that reciprocates the punch head along a vertical axis. In use, the punch head 16 moves through four positions, that will be described in further detail below.

The apparatus also includes pushers 34 extending towards the punch head for folding the side portions 22 of the blank 14 against the punch head 16 and pushers 36 extending towards the punch head 16 for folding of the end portions 24 of the blank 14 against the punch head 16.

Pushers 34 and 36 act sequentially so that sides portions 22 of the blank 14 are first folded to form sides of the carton 12 and then end portions 24 of the blank 14 are folded to form ends of the carton 12. It will be appreciated that the reverse order is also possible with ends of the carton being folded before the sides.

Once sides and ends of the carton 12 have been formed, gussets 30 are formed between the sides and ends. Gussets 30 are glued to either the outer sides or ends of the carton 12 by glue applied the locations 28 and folding the gussets 30 against that glue and allowing it to set.

To fold outer portions 22*a* of the side portions and outer portions 24*a* of the end portions 24, the apparatus 12 also includes at least one engagement member 18 extending along sides of the punch head 16. In the illustrated embodiment, the engagement member 18 includes a plurality of fingers 38 pivotably fixed to the punch head 16 for folding outer portions 22*a*, 24*a* of the side and end portions (22, 24 respectively) of the blank 14 away from the punch head 16 and against respective external sides and ends of the carton 12.

The apparatus 10 may be configured for folding outer portions 22*a* immediately after folding side portions 22 and for folding outer portions 24*a* immediately after folding end portions 24 so that outer portions 22*a* are folded prior to outer portions 24*a*, though it will be appreciated that outer portions 22*a* and outer portions 24*a* may also be formed at the same time. The outer portions 22*a*, 24*a* may also be folded after a predetermined delay.

In an alternative embodiment, the apparatus 10 may be provided with a single engagement member 18 along each side, which may be an elongate pusher for example. In further alternative embodiments, the engagement member may be a single generally square member like a collar around the punch head, that lowers to simultaneously fold outer portions 22*a*, 24*a*.

As can be seen in FIGS. 6 to 10, each set of fingers 38 are fixed to rail 40. Rail 40 is pivotably mounted via brackets 41 and spacers 43 may be provided along the short side of the punch head 16. Rail 40 is pneumatically operable via actuators 42 each fitted to a crank arm 46 which is fixed to rail 40 so that actuation of the actuators results in rotation of the rail 40 to simultaneously operate each of the fingers 38 along a side of the punch head 16 at the same time. In the illustrated embodiment, each actuator is fitted to shaft 39 that is supported between the crank arm 46 and a central finger 38. The fingers 38 extend outwardly from the punch head 16 to prevent the outer side and end portions 22*a*, 24*a* of the blank 14 folding completely so as to lie against the punch head 16 as pushers 34, 36 fold in the sides ends of the carton 12.

Figure 10:
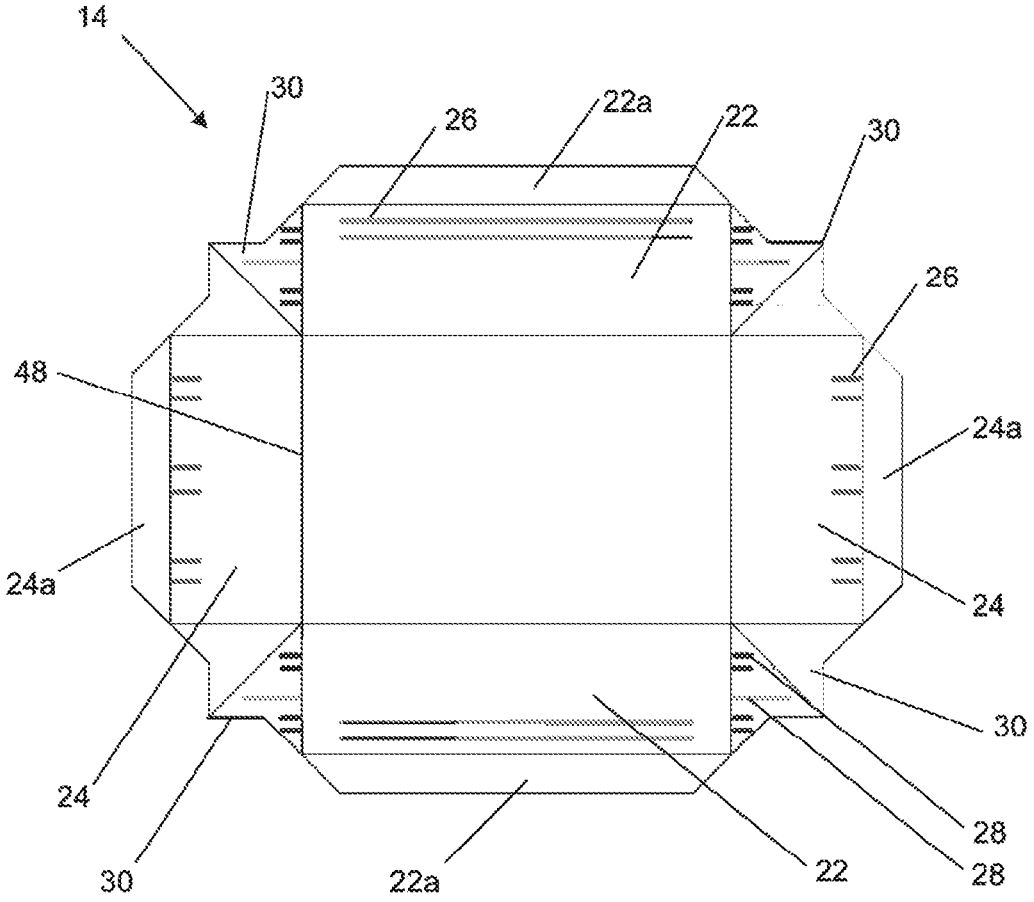
FIG. 10 is a underneath view of the blank used in the described apparatus and method.

As can be seen from the blank 14 illustrated in FIG. 10, glue is applied at locations 26 to allow the outer portions 22*a*, 24*a* to adhere to respective side portions 22 and end portions 24 once folded to bring the outer portions 22*a*, 24*a* into contact with external sides and ends of the carton 12. Glue is also applied at locations 28 to allow corner gussets 30 formed between the side and end portions 22, 24 to be fixed to a side of the carton 12.

Although blank 14 is described herein as having side and end portions, these terms are not intended to imply that one is longer than the other and it will be appreciated that, in addition to being generally rectangular, the carton may also be generally square with equal length sides and ends, or with sides shorter than the ends. As illustrated in FIG. 10, blank 14 is pre-scored along lines 48 to facilitate folding of the carton 12 within the apparatus 10.

Blank 14 is fed from a magazine loader (not shown) which is manually loaded by an operator.

Blank 14 is transferred from the loader via a plurality of suction members 32 that engage the blank 14 and transfer it from the magazine loader, and onto a conveyor (not shown) that transfers the blank 14 toward the punch head 16. Suction members 32 operate via a PLC controlled vacuum circuit. Openable bomb doors are used to support the blank once the suction members 32 are released. The conveyor is preferably a chain drive with pushing dogs attached to it.

According to one embodiment of the invention, in use carton 12 is formed by engaging the blank 14 with punch head 16, against which the carton is formed. Side portions 22 of the blank 14 are then folded against the punch head 16 to form sides of the carton 12. Outer side portions 22*a* of the blank 14 are then folded away from the punch head 16 and against an external side of the carton 12.

End portions 24 of the blank 14 are then folded against the punch head 16 to form end portions of the carton 12 and outer end portions 24*a* folded away from the punch head 16 and against an external end of the carton 12.

Once side and end portions 22, 24 of the blank 14 are folded, gussets 30 are formed therebetween and these can be securing against sides or ends of the carton.

The punch head 16 operatively corresponds to an internal portion of the carton 12 so that the carton 12 can be formed against or around the punch head. Folding of the side and end portions 22, 24 of the blank 14 is completed with pushers 34, 36 extending towards the punch head 16.

While forming the carton 12, the blank 14 is supported along outer edges via support members prior to engagement with the punch head 16. As punch 16 engages blank 14, side and end portions as the blank 14 are partially folded.

In the described embodiments, the step of folding the outer side and end portions 22*a*, 24*b* is performed by at least one engagement member 18 extending along sides of the punch head 16, the engagement member 18 including a plurality of fingers 38 pivotably fixed to the punch head 16 for folding the outer portions 22*a*, 24*a* downwardly and against the external side of the carton 12.

The method further includes the step of applying glue to side and end portions of the blank for securing the outer side and end portions once folded. The glue is preferably applied to an underneath side of the blank 14 and the location of application for the glue can be seen from reference numeral 26 in FIG. 10, though it will be appreciated that other gluing locations can similarly be used.

Figure 2:
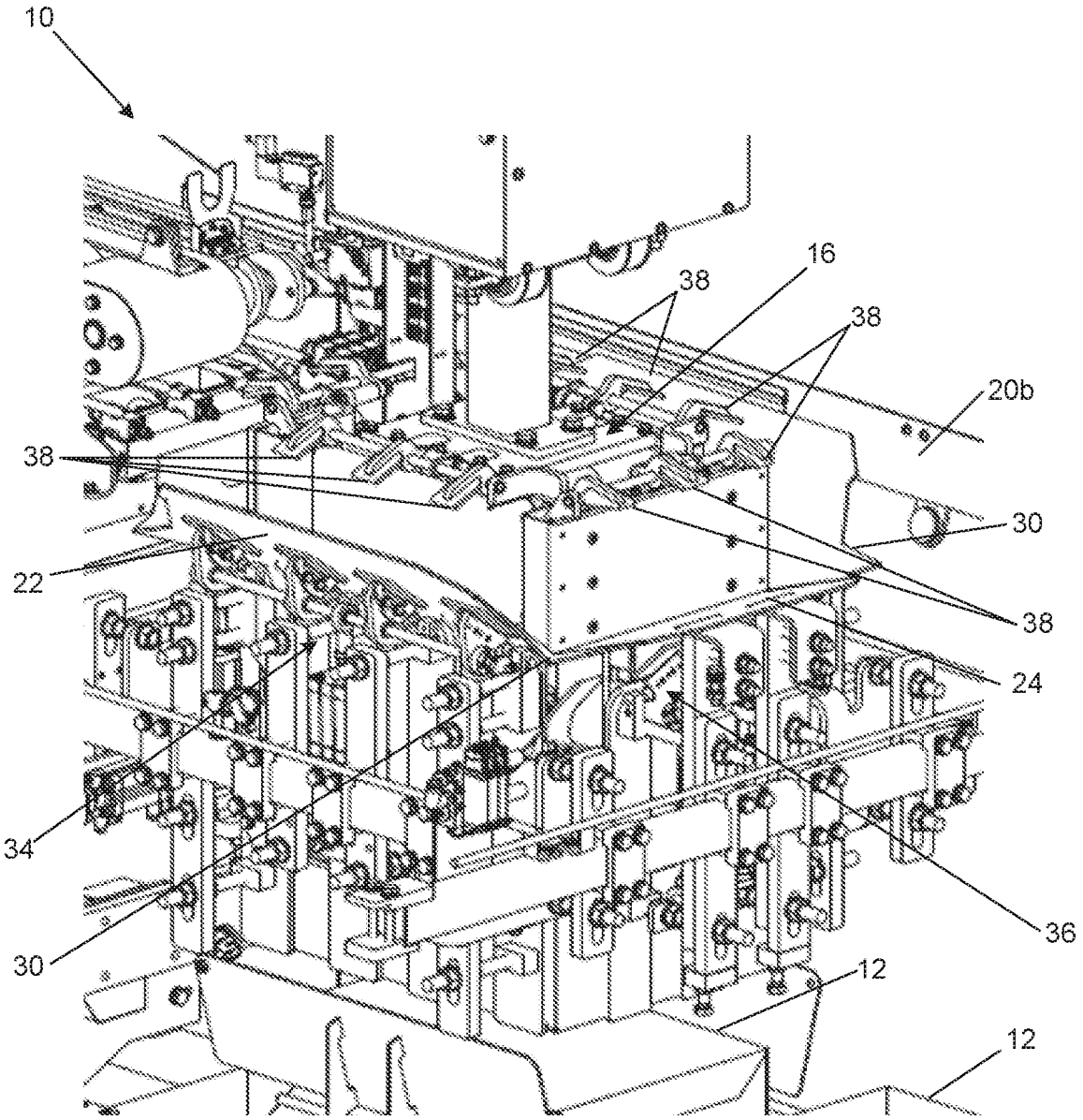
Figure 3:
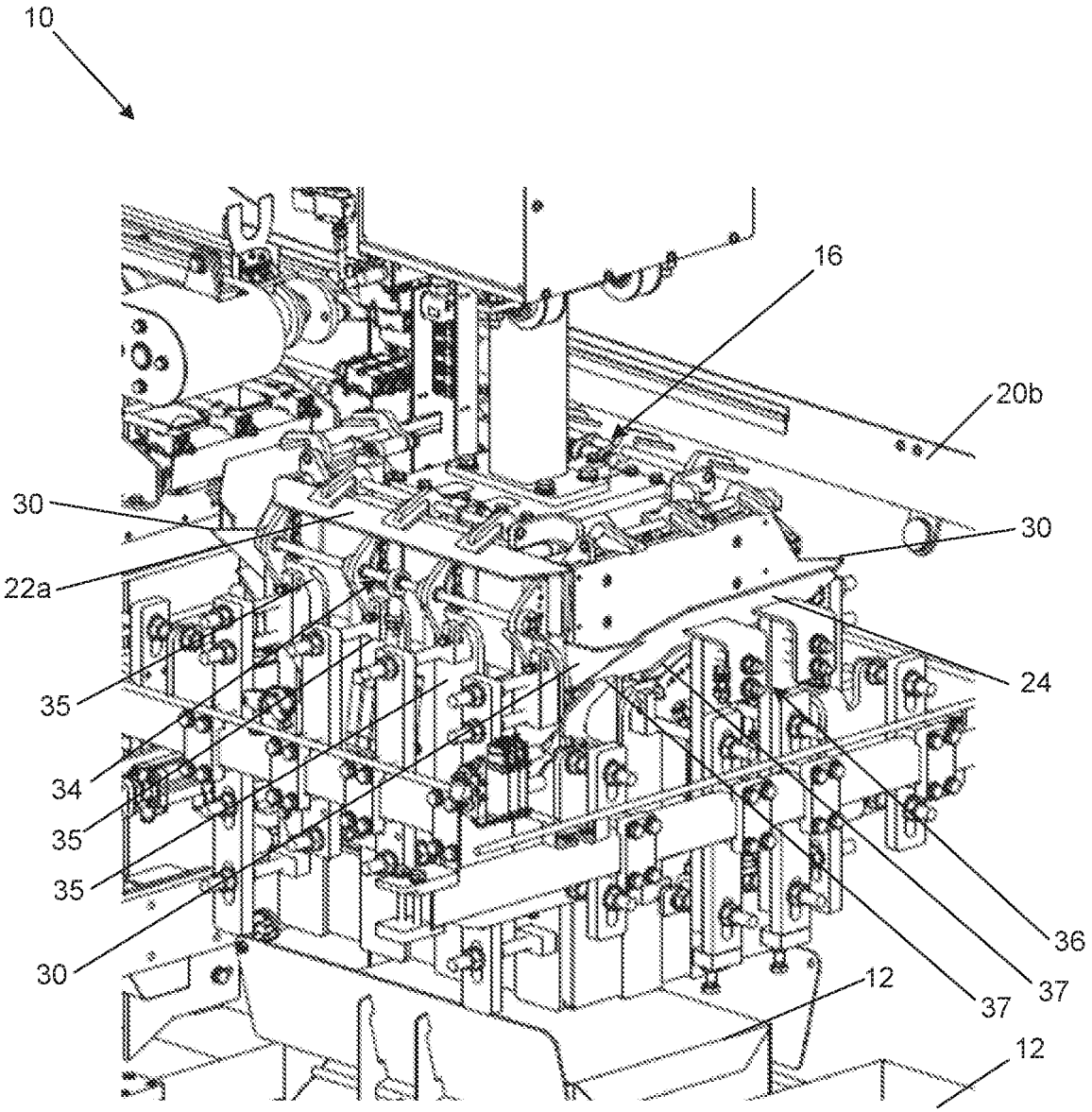

FIGS. 1 to 5 illustrate the method according to embodiments of the invention where sides of the carton are formed prior to ends of the carton. As mentioned above, the punch head 16 moves through four positions. Starting in a rest position as illustrated in FIG. 1, the punch head 16 moves downwardly to a first fold position, as shown in FIG. 2. In this position side portions 22 of the blank 14 are folded by pushers 34 which advance toward the punch head 16.

Pushers 34 are formed with mandrel plates 35 that are angled at an upper end to provide a constricting forming path to apply pressure to the side portions 22 as the punch head 16 is advanced. The mandrel plates 35 hold the folded sides in position while the other folds are being performed. The mandrel plates 35 are formed in strips so that fingers 38 can pass between adjacent pushers 34 as the punch head 16 is advanced downwardly.

Figure 4:
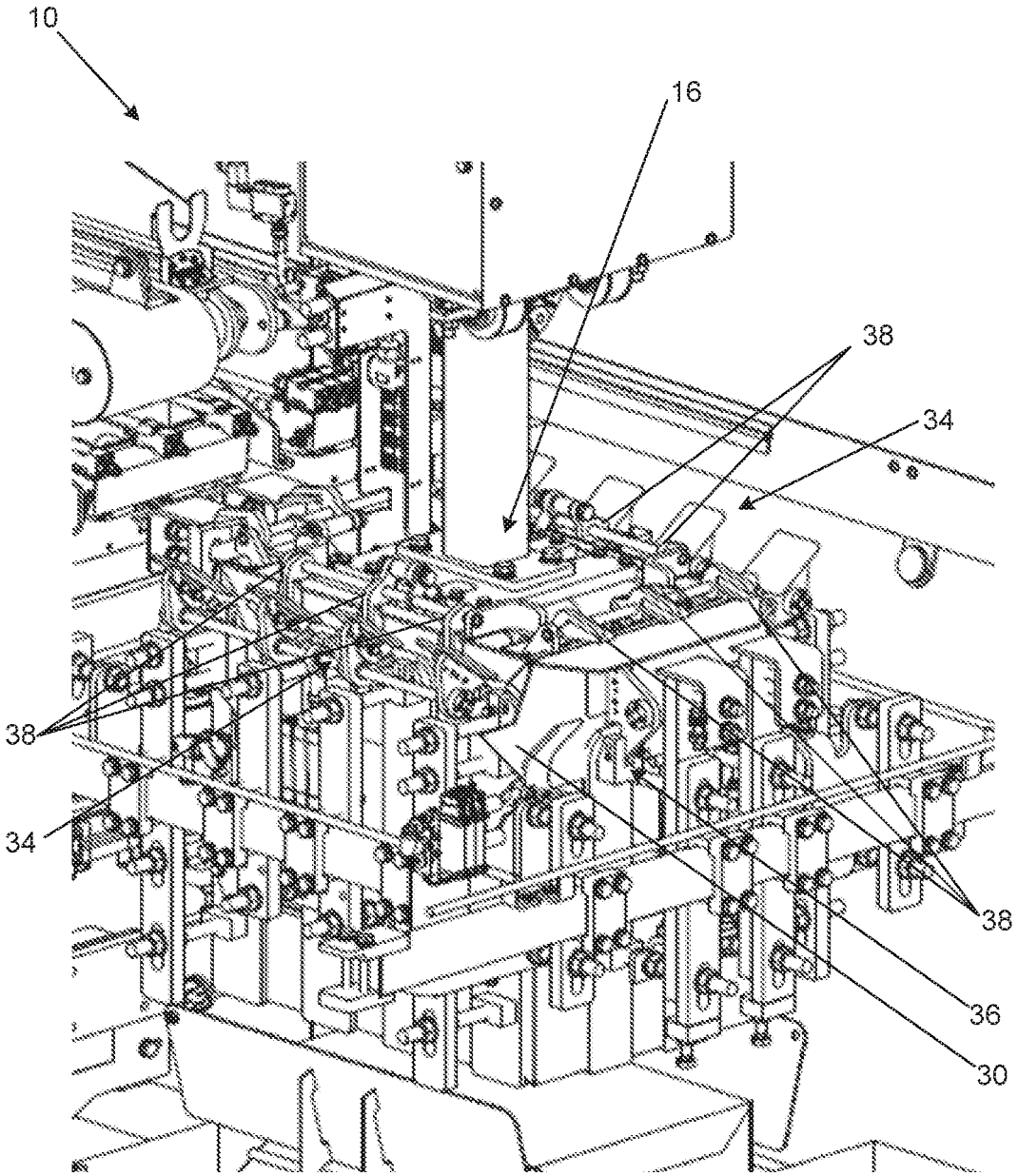

Prior to or while advancing the blank 14 toward the second position illustrated in FIG. 4, fingers 38 fold the outer side portions 22*a* of the blank 14 over and against an external side edge of the carton 12.

From the first fold position the punch head 16 is then further advanced downwardly to the second fold position illustrated in FIG. 4. In this position, end portions 24 of the blank 14 are folded against the punch head 16 with pushers 36. Pushers 36 are also formed with mandrel plates 37 that are angled at an upper end to provide a constricting forming path to apply pressure to the end portions 24 as the punch head 16 is advanced. The mandrel plates 37 hold the folded sides in position while the outer end portions 24*a* and the gussets 30 are being folded. The mandrel plates 37 of pushers 36 are also formed in strips so that fingers 38 can pass between adjacent pushers 36 as the punch head 16 is advanced.

Figure 5:
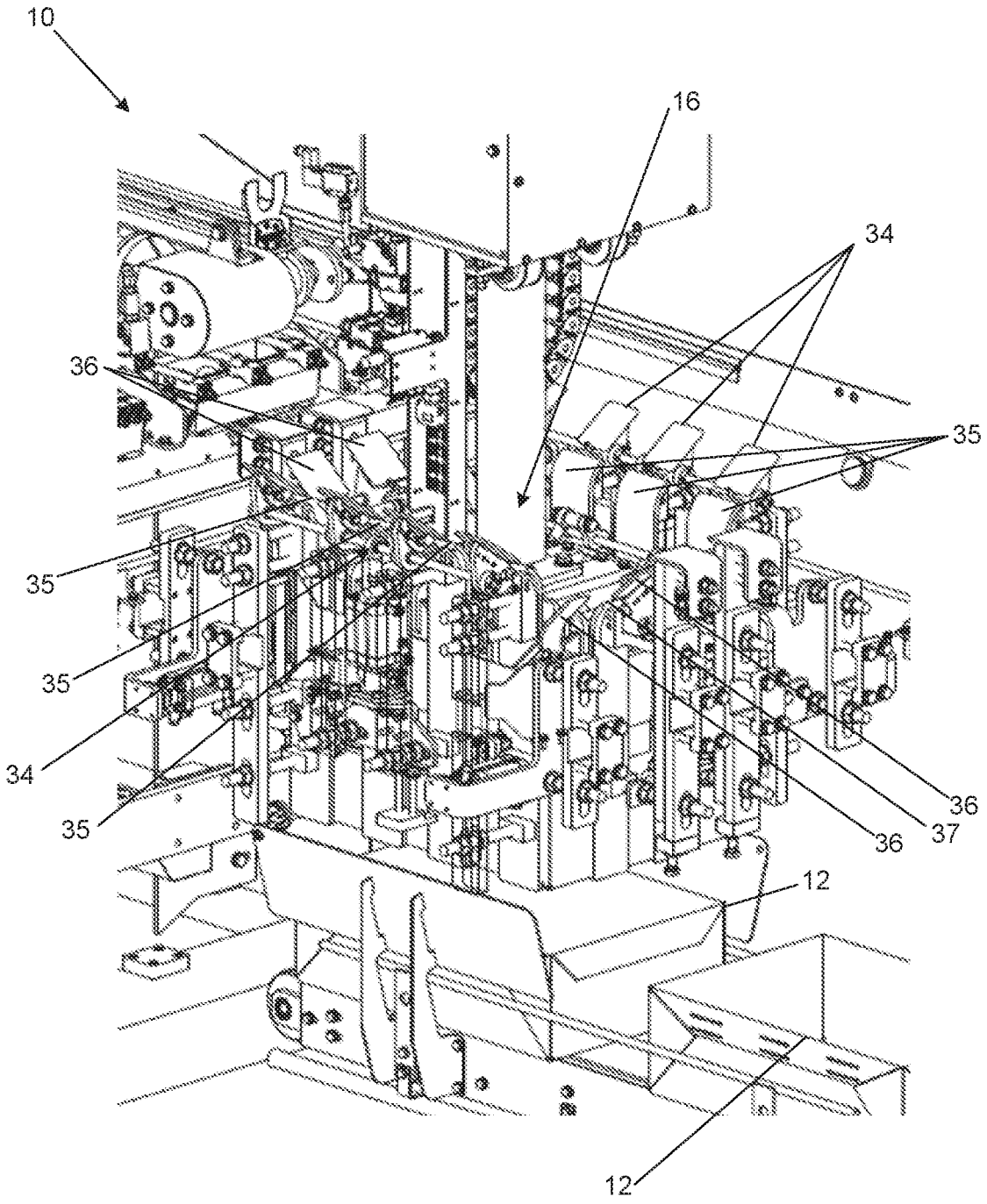

Prior to or while advancing the blank toward the third position illustrated in FIG. 5, fingers 38 fold the outer end portion 24*a* of the blank 14 over and against an external side edge of the carton 12.

From the second fold position of FIG. 4, the punch head 16 is then further advanced to the third fold position illustrated in FIG. 5. In this position, gussets 30 formed between the side and end portions 22, 24 are folded against either the side or end of the carton.

Following folding of the gussets 30, the punch head 16 is then advanced to a final holding position where the carton is held against support surfaces that apply pressure to the carton 12 for the purpose of allowing the glue to set. In moving into the final holding position, a previously formed carton 12 is pushed downwardly from the apparatus 10 and onto an exit conveyor (not shown) for collection by an operator as a ready to use carton or transportation to a production line or stacker. The carton 12 is held momentarily in the final holding position until the formed carton 12 is released and the punch head 16 retracted, leaving the carton 12 held in position until the following carton pushes it onto the exit conveyor. The exit conveyor is preferably a cord belt motor driven conveyor which may be provided with a photo eye to detect blockages.

The above described method is performed with a blank 14 of paper based material coated with a waterproof coating. The blank may be coated or a laminate and may be combination of barrier layers. Preferably, the blank is pre-scored to facilitate folding.

Although the above described steps of forming carton 12 from blank 14 have been described in a particular order, it will be appreciated that they may be performed in other sequences. For example, ends of the carton may be formed before the sides.

The embodiments have been described by way of example only and modifications are possible within the scope of the invention disclosed.

REFERENCE NUMERALS

10 Apparatus for erecting a carton from a blank
12 Carton
14 Blank
16 Punch head
18 Engagement member
20 Side support members (20*a*, 20*b*, 20*c*, 20*d*)
22 Side portions (outer portions 22*a*)
24 End portions (outer portions 24*a*)
26 Glue locations for securing sides and ends
28 Glue locations for gussets
30 Gussets
32 Suction member
34 Side pushers
35 Mandrel
36 End pushers
37 Mandrel
38 Fingers
39 Shaft
40 Rail
41 Bracket
42 Actuators
43 Spacers
44 Side panels
46 Crank arm
48 Pre-scoring lines

What is claimed is:

1. A method of erecting a carton from a blank, including:

applying glue to the side portions and the end portions of the blank for securing outer portions of the side portions and outer portions of the end portions once folded respectively thereover;

engaging the blank with a punch head against which the carton is formed;

folding side portions of the blank against the punch head to form sides of the carton, wherein folding is completed with first pushers advancing towards the punch head, wherein the first pushers extend towards respective engagement members extending along sides of the punch head and wherein the first pushers are formed with first mandrel plates that are angled at an upper end to provide a constricting forming path to apply pressure to the side portions as the punch head is advanced;

folding, while the first mandrel plates hold the folded side portions, outer portions of the side portions of the blank against respective external sides of the carton;

folding end portions of the blank against the punch head to form end portions of the carton, wherein folding is completed with second pushers advancing towards the punch head, and wherein the second pushers extend towards respective engagement members extending along sides of the punch head and wherein the second pushers are formed with second mandrel plates that are angled at an upper end to provide a constricting forming path to apply pressure to the end portions as the punch head is advanced;

folding, while the second mandrel plates hold the folded end portions, outer portions of the end portions of the blank against respective external ends of the carton; and securing corner gussets formed between the side and end portions against sides or ends of the carton, while the second mandrel plates hold the folded end portions, wherein the engagement members each include a plurality of fingers pivotably fixed to, and extending outwardly from, the punch head for folding the outer portions of the side portions and outer portions of the end portions downwardly over respective of the first and second mandrel plates and against respective external sides of the carton so that goods stored there in avoid contact with diecut raw side edges of the carton, and wherein the first and second mandrel plates are formed in strips that allow the plurality of fingers to pass between the first plurality of pushers and allow the plurality of fingers to pass between the second pushers as the punch head is advanced.

2. A method according to claim 1, wherein the blank is supported along outer edges prior to engagement with the punch head to partially fold the side and end portions as the blank is engaged with the punch head.

3. A method according to claim 1, wherein the blank is formed of paper based material coated with a waterproof coating or formed of barrier papers, or plastic laminated paper and/or board.

4. A method according to claim 1, wherein the punch head operatively corresponds to an internal portion of the carton.

5. An apparatus for erecting a carton from a blank, the apparatus including:

a support for supporting the blank near outer edges thereof;

a vertically operable punch head for engaging the blank and against which sides and ends of the carton can be formed;

and pushers advancing towards the punch head for folding of side portions and end portions of the blank against the punch head, wherein the pushers extend towards respective engagement members extending along sides of the punch head, and wherein the pushers are formed with mandrel plates that are angled at an upper end to provide a constricting forming path to apply pressure to the side portions and the end portions as the punch head is advanced;

wherein the engagement members each include a plurality of fingers pivotably fixed to, and extending outwardly from, the punch head for folding outer portions of the side portions and outer portions of the end portions downwardly over respective mandrel plates and against respective external sides of the carton so that goods stored there in avoid contact with diecut raw side edges of the carton, wherein the first and second mandrel plates are formed in strips so that the plurality of fingers pass between the pushers as the punch head is advanced.

6. An apparatus according to claim 5, wherein the punch head operatively corresponds to an internal portion of the carton.

* * * * *